US005409629A

United States Patent [19]

Shulman et al.

[11] Patent Number: 5,409,629

[45] Date of Patent: Apr. 25, 1995

[54] USE OF ACRYLIC ACID/ETHYL ACRYLATE COPOLYMERS FOR ENHANCED CLAY SOIL REMOVAL IN LIQUID LAUNDRY DETERGENTS

[75] Inventors: Jan E. Shulman, Newtown; Charles E. Jones, Yardley, both of Pa.

[73] Assignee: Rohm and Haas Company, Philadelphia, Pa.

[21] Appl. No.: 732,976

[22] Filed: Jul. 19, 1991

[51] Int. Cl.[6] ..... C11D 3/37; C11D 3/39

[52] U.S. Cl. ..... 252/174.23; 252/174.24; 252/DIG. 2; 252/DIG. 14; 252/173; 252/DIG. 15; 252/173; 134/42

[58] Field of Search ..... 252/174.23, 174.24, 252/DIG. 15, DIG. 2, DIG. 14, 173; 134/42

[56] References Cited

U.S. PATENT DOCUMENTS

| | | | |
|---|---|---|---|
| 3,328,309 | 6/1967 | Grifo | 252/137 |
| 3,782,898 | 1/1974 | Mandell, Jr. | 8/137 |
| 3,922,230 | 11/1975 | Lamberti et al. | 252/89 |
| 3,993,830 | 11/1976 | Dickson et al. | 428/290 |
| 4,490,271 | 12/1984 | Spadini et al. | 252/174.23 |
| 4,664,848 | 5/1987 | Oh et al. | 256/547 |
| 4,678,596 | 7/1987 | Dupre et al. | 252/174.22 |
| 4,698,174 | 10/1987 | Denzinger et al. | 252/174.24 |
| 4,702,858 | 10/1987 | Denzinger et al. | 252/174.24 |
| 4,797,223 | 1/1989 | Amick et al. | 252/DIG. 15 |
| 4,814,102 | 3/1989 | Baur et al. | 252/174.24 |
| 4,895,658 | 1/1990 | Amjad | 210/636 |
| 4,897,220 | 1/1990 | Trieselt et al. | 252/DIG. 2 |
| 4,999,869 | 3/1991 | Holland | 252/DIG. 15 |
| 5,004,557 | 4/1991 | Nagarajan | 252/174.24 |
| 5,055,540 | 10/1991 | Hughes et al. | 526/318.2 |
| 5,076,957 | 12/1991 | Diehl et al. | 252/174.23 |
| 5,126,069 | 1/1992 | Kud et al. | 252/174.23 |

FOREIGN PATENT DOCUMENTS

| | | | |
|---|---|---|---|
| 0213500 | 8/1986 | European Pat. Off. | 252/174.23 |
| 245987 | 11/1987 | European Pat. Off. . | |
| 324568 | 7/1989 | European Pat. Off. . | |
| 368214 | 5/1990 | European Pat. Off. . | |
| 421664 | 4/1991 | European Pat. Off. . | |
| 459077 | 12/1991 | European Pat. Off. . | |
| 0523950 | 1/1993 | European Pat. Off. . | |
| 8065795 | 4/1983 | Japan . | |

*Primary Examiner*—Paul Lieberman
*Assistant Examiner*—Kery Fries
*Attorney, Agent, or Firm*—David T. Banchik

[57] ABSTRACT

This invention relates to the use of acrylic acid/ethyl acrylate copolymers as a liquid laundry detergent additive. Incorporating from about 0.5 to about 5 weight percent of an acrylic acid/ethyl acrylate copolymer into a liquid detergent formulation provides enhanced performance on the clay soil removal properties of the detergent. Particularly useful are copolymers containing as polymerized units from 70 to 98 percent by weight acrylic acid and 2 to 30 percent by weight ethyl acrylate.

9 Claims, No Drawings

USE OF ACRYLIC ACID/ETHYL ACRYLATE COPOLYMERS FOR ENHANCED CLAY SOIL REMOVAL IN LIQUID LAUNDRY DETERGENTS

FIELD OF THE INVENTION

This invention relates to use of certain water soluble copolymers in laundry detergent compositions. More specifically, this invention relates to the use of water soluble acrylic acid/ethyl acrylate copolymers in liquid laundry detergent compositions to provide enhanced clay soil removal.

BACKGROUND OF THE INVENTION

Certain water soluble polymers and copolymers have been known to impart favorable performance and processing properties when incorporated into detergent formulations. These properties range from incrustation inhibition to lowering crutcher viscosity. Although the benefits of certain polymers in detergent formulations has been appreciated by those skilled in the art, polymers have previously found very little utility in liquid laundry detergents. The most important reason polymers and copolymers are added to detergent formulations is to improve the performance of the detergent with regard to stain removal. Stains can generally be classified as belonging to one of the following groups: particulates (e.g. clay soil), oily particulates (e.g. sebum), oxidizable (e.g. tea stains), and enzyme sensitive (e.g. grass). We have found that the addition of certain copolymers to liquid laundry detergents imparts enhanced performance of the clay-soil removal properties of the liquid laundry detergent.

Certain polymeric additives for liquid laundry detergents are disclosed in European Patent Application No. 368,214. This patent application discloses improved primary and secondary washing action of liquid laundry detergents which include copolymers of (a) monoethylenically unsaturated mono- and di-carboxylic acids and esters thereof, and (b) amides of monoethylenically unsaturated $C_3$–$C_8$ carboxylic acids. Similar polymeric additives are disclosed in U.S. Pat. No. 4,702,858 to Denzinger et al. (Denzinger). Denzinger discloses amine-neutralized polymers including homopolymers of acrylic acid, homopolymers of methacrylic acid, copolymers of acrylic acid/methacrylic acid, and copolymers of $C_4$–$C_6$ ethylenically unsaturated dicarboxylic acids with acrylic acid, methacrylic acid or $C_2$–$C_6$ alkyl esters of ethylenically unsaturated $C_3$–$C_6$ carboxylic acid.

U.S. Pat. No. 3,328,309 to Grifo discloses the use of certain polymeric additives to heavy duty liquid detergent formulations as stabilizers. These polymeric additives comprise as copolymerized units a) ethylenically unsaturated anhydrides, and b) monomers containing the group $$C{=}CH_2$$

including acrylic acid and derivatives of acrylic acid such as methyl acrylate and ethyl acrylate.

U.S. Pat. No. 4,664,848 to Oh et al. addresses the problem of clay soil removal and anti-redeposition in powdered and liquid laundry detergents. Oh et al. disclose the addition of ethoxylated cationic monoamines, ethoxylated cationic diamines, ethoxylated cationic polyamines, ethoxylated cationic polymers and mixtures thereof to liquid and granular detergent formulations.

Japanese Patent Application 58065795 discloses low molecular weight polymers and copolymers in liquid detergent compositions comprising (a) 1–15 percent by weight of nonionic or anionic surfactant, (b) 1–15 percent by weight of a homopolymer of acrylic acid and (c) 1–15 percent by weight of a hydrotropic agent such as ethanolamine salts of p-toluenesulphonic acid. It is further disclosed that the polymers may contain up to 5 mole percent of a comonomer and that the liquid detergents have improved storage stability and detergency for mud stains.

U.S. Pat. No. 4,814,102 to Bauer et al., discloses polymeric detergent additives comprising monoethylenically unsaturated $C_3$–$C_6$ carboxylic acids reacted with ethylene oxide, propylene oxide, n-butylene oxide or isobutylene oxide for use as a builder and for providing dispersing power for pigment dirt in powdered detergents.

U.S. Pat. No. 4,698,174 to Denzinger et al., discloses various copolymers of acrylic acid and maleic acid as additives for pulverulent detergents and cleaning agents.

U.S. Pat. No. 3,922,230 to Lambertl et al. discloses biodegradable oligomeric polyacrylates for use as detergent builders. The oligomers are terminated with hydroxy groups and/or sulfur groups.

U.S. Pat. No. 4,490,271 to Spadini, et al., discloses a mixture of acrylic homopolymers or copolymers and polyethylene glycol as additives to a surfactant-based phosphate-free powdered detergent formulation. It is disclosed that these detergents enhance clay soil removal. The copolymers disclosed by Spadini may contain up to 20 percent by weight of methacrylic acid, hydroxyacrylic acid, vinyl chloride, vinyl alcohol, furan, acrylonitrile, methacrylonitrile, vinyl acetate, methyl acrylate, methyl methacrylate, styrene, alpha-methylstyrene, vinyl methyl ether, vinyl ethyl ether, vinyl propyl ether, acrylamide, ethylene, propylene and 3-butenoic acid.

SUMMARY OF THE INVENTION

It is an object of this invention to enhance the clay soil removal properties of liquid detergent formulations. This objective is achieved by incorporating into the formulations a copolymer containing as polymerized units acrylic acid and ethyl acrylate in an amount effective to provide enhanced clay soil removal. As used hereinafter, and in the appended claims, the term "acrylic acid" is intended to include not only acrylic acid itself, but also salts of acrylic acid such as the alkali metal, ammonium and amine salts of acrylic acid, and combinations thereof, unless a clearly different meaning is indicated.

DETAILED DESCRIPTION OF THE INVENTION

The clay soil removal properties of liquid laundry detergents can be enhanced by incorporating into the formulation copolymers which contain as polymerized units acrylic acid and ethyl acrylate in an amount effective to enhance clay soil removal. In one embodiment, we have found a method of enhancing the clay soil removal properties of a liquid detergent composition comprising adding to the detergent composition from about 0.5 to about 5 percent by weight of a copolymer containing as polymerized units a) from about 70 to about 98 percent by weight acrylic acid or salts thereof, and b) from about 2 to about 30 percent by weight ethyl acrylate.

Methods of making the copolymers for this invention are well known to persons skilled in the art of copolymerization. U.S. Pat. No. 4,314,004 is directed to one suitable synthesis and the disclosure thereof is incorporated herein by reference. This method requires a specific concentration range of a copolymerization initiator and a specific molar ratio range of the initiator concentration and the concentration of certain metal salts to obtain the desired low molecular weight copolymers useful in the present invention.

Another suitable method for preparing these low molecular weight copolymers is described in U.S. Pat. No. 4,301,266, the disclosure thereof also being incorporated herein by reference. In this process isopropanol is used as the molecular weight regulator as well as the reaction solvent. The reaction solvent may also be an aqueous mixture of isopropanol containing at least 40 percent by weight isopropanol.

The process used to prepare the copolymers may be aqueous based or solvent based, it may be run as a batch process, a semi-continuous process or continuous process, the reaction may be thermally initiated, redox initiated or free-radical initiated. The copolymers may be isolated from solution by any of the conventional means or it may be used as a dilute solution. Preferably, the process used for the production of the copolymers is an aqueous based, free-radical initiated process and the copolymer is used as a dilute aqueous solution.

The acrylic acid portion of the copolymer may be present in the acid form, or as one of the water, soluble salts of acrylic acid. Such salts include alkali metal salts, ammonium salts, or amine salts. The copolymers contain, as polymerized units, acrylic acid at a level of from about 70 to about 98 percent by weight of the copolymer. Preferably, the copolymers contain acrylic acid at a level of from about 80 to about 95 percent by weight of the copolymer.

The copolymers also contain as polymerized units ethyl acrylate. The level of ethyl acrylate in the copolymers is from about 2 to about 30 percent by weight of the copolymer. Preferably, the copolymers contain ethyl acrylate at a level of from about 5 to about 20 percent by weight of the copolymer.

The weight average molecular weight ($M_w$) of the copolymers is from about 1,000 to about 30,000, preferably from about 1,500 to about 10,000 and most preferably from about 2,000 to about 7,000 as measured by aqueous gel permeation chromatography (GPC).

The copolymers may be incorporated into the liquid detergent formulation at levels where they provide the intended benefit. Generally this level will be from about 0.5 to about 5 percent by weight of polymer solids based on the total liquid detergent formulation. Preferably, the copolymers are present at levels of from about 1 to about 4 percent and most preferably at about 3 percent by weight of polymer solids based on the total liquid detergent formulation. At copolymer levels below 0.5 percent by weight, the desired effects on clay soil removal are not observed. At levels above 5 percent, the copolymers are generally incompatible with liquid laundry detergent formulations. The homopolymers of acrylic acid which were evaluated were not compatible with the liquid laundry detergent formulations. The copolymers of the present invention are more compatible than the acrylic acid homopolymers in liquid laundry detergent formulations.

The liquid detergent formulations to which the copolymers may be added are any of those typically available. These formulations generally contain surfactants, builders, buffering agents, bleaches, enzymes, stabilizers, perfumes, whiteners, softeners, preservatives, opacifiers, and water.

Although anionic, cationic, nonionic and zwitterionic surfactants may each be used in liquid detergent formulations, such formulations usually contain anionic and nonionic surfactants. Suitable anionic surfactants include, for example, $C_8$ to $C_{12}$ alkylbenzenesulfonates, from $C_{12}$ to $C_{16}$ alkanesulfonates, $C_{12}$ to $C_{16}$ alkylsulfates, $C_{12}$ to $C_{16}$ alkylsulfosuccinates and $C_{12}$ to $C_{16}$ sulfated ethoxylated alkanols. Suitable nonionic surfactants include, for example, $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. The surfactants usable in detergents can also have an amphoteric character and they can be soaps. In general, the surfactants constitute from 2 to 50, preferably 5 to 45 percent by weight of the detergent formulation.

Examples of builders typically present in liquid formulations include phosphates, specifically, orthophosphates, pyrophosphates and especially sodium tripolyphosphate. Further examples are the zeolites, sodium carbonate, low molecular weight polycarboxylic acids, nitrilotriacetic acid, citric acid, tartaric acid, the salts of the aforesaid acids and the monomeric, oligomeric or polymeric phosphonates. Builders are generally present in the liquid detergent formulations at levels of from about 0.5 to about 30 percent by weight and preferably from about 5 to about 20 percent by weight of the formulation.

Other common additives to detergent and cleaning agent formulations are bleaching agents, used in an amount of up to 30 percent by weight of the formulation; corrosion inhibitors, such as silicates, used in an amount of up to 25 percent by weight of the formulation; and graying inhibitors used in an amount of up to 5%. Suitable bleaching agents are for example, perborates, percarbonates or chlorine-generating substances, such as chloroisocyanurates. Suitable silicates used as corrosion inhibitors are, for example, sodium silicate, sodium disilicate and sodium metasilicate and examples of graying inhibitors are carboxymethylcellulose, methylcellulose, hydroxypropylmethylcellulose and graff copolymers of vinyl acetate and polyalkylene oxides having a molecular weight of 1000 to 15,000. Other common detergent additives optionally used are optical brighteners, enzymes and perfumes. In addition, liquid detergents may contain up to 80 wt % of water.

Liquid Detergent Formulation and Performance Evaluation

The efficacy of the polymers of this invention in a liquid detergent formulation was evaluated by washing soiled cotton fabrics in a commercially available, heavy duty liquid composition utilizing Sears Kenmore® Ultra Fabric Care brand washing machines (model Heavy Duty 80 Series) set to typical U.S. laundering parameters. Washing conditions are detailed in Table I below, and the liquid detergent formulation base used for evaluating the copolymers of the invention was, for example, that shown in European Patent Application EP-0-348183 and depicted in Table II. Table III shows other suitable formulations for liquid detergents which are possible but not limiting for. use with the copolymers of the invention.

Cotton cloth #405 was purchased from Test Fabrics, Inc. (Middlesex, N.J.) and cut to a specified size (3½"×4½"). The cloths were then soiled by applying from 0.7 to 0.8 grams of a 25% clay slurry (in water) using a China bristle brush (#10). The soil was "painted" onto the cloth inside a 2" diameter circle and allowed to air dry overnight prior to laundering.

The clays used to soil the cloths were of two types: a) a reddish-brown particulate clay, and b) a deep-orange clay. In addition, cloths presoiled with clay were purchased from Scientific Services (Oakland, N.J.). The clay used by Scientific Services was a brown clay. Reflectance of each of the cloths was measured using a Pacific Scientific Colorimeter (Colorgard System 1000) and the data recorded using the X,Y,Z color scale. The reflectance (Y) of the soiled cloths was measured before laundering so that only cloths of the same reflectance were used in a test. Reflectance was then measured after laundering to evaluate the efficacy of the detergent. The ΔY values reported in Table IV are the change in reflectance relative to the control cloths laundered in detergent not containing polymer.

Each of the three clay soils were evaluated with four replicates. The data appearing in Table IV are composite averages of the reflectance values obtained from all of the clay soils laundered with the polymer listed.

TABLE I

| WASH CONDITIONS | |
|---|---|
| APPARATUS- | SEARS KENMORE BRAND WASHING MACHINE |
| TEMPERATURE- | WARM (95° F.) |
| WATER HARDNESS- | MODERATE (120 PPM) |
| AGITATION- | HIGH |
| WASH CYCLE- | MEDIUM (10 MIN.) |
| WATER CAPACITY- | 16.7 GALLONS/LOAD |
| DETERGENT DOSAGE- | ½ CUP (130 GRAMS) |
| RECOMMENDED LEVEL- | |
| POLYMER CONCENTRATION- | 3% SOLIDS (NEUTRALIZED, pH 7) |

TABLE II

| BASE LIQUID DETERGENT FORMULATION | |
|---|---|
| Component | % by weight |
| Surfactants | |
| Linear Dodecylbenzene Sulfonate | 17.00 |
| Alcohol Ethoxylate (Nonionic) | 7.00 |
| Builder | 10.00 |
| Sodium Citrate | |
| Hydrotrope/Solubilizing Agent | 2.00 |
| Monoethanolamine | |
| Misc.* and Water up to | 100% |

*Misc. includes perfume, colorants, fatty acids, whiteners and opacifiers.

TABLE III

| LIQUID COMPOSITIONS | | | | | |
|---|---|---|---|---|---|
| | Unbuilt | Citrate | Citrate/ Fatty Acid Soap | Phos-phate | Non-Phosphate |
| LAS | 3.5 | 15 | 8 | 7 | 19 |
| Alc. Ether | — | — | 16 | — | — |

TABLE III-continued

| LIQUID COMPOSITIONS | | | | | |
|---|---|---|---|---|---|
| | Unbuilt | Citrate | Citrate/ Fatty Acid Soap | Phos-phate | Non-Phosphate |
| Sulfate | | | | | |
| Citrate | — | 10 | 6 | — | — |
| Fatty Acid Soap | — | — | 10 | — | — |
| Nonionic Surfactant | 16 | 7.5 | 6 | 3 | 15 |
| Propylene Glycol | — | — | 8 | — | 4 |
| Ethanol | 5 | — | 4 | — | 8.5 |
| Na Xylene Sulfonate | — | 5.5 | — | — | — |
| Opt. Brightener | 0.2 | 0.2 | 0.15 | 0.1 | 0.25 |
| Enzyme | 0.7 | — | 0.5 | 0.5 | 0.75 |
| Water | Q.S. | Q.S. | Q.S. | Q.S. | Q.S. |
| Borax | — | — | — | 3 | — |
| Tripoly-phosphate | — | — | — | 23 | — |
| Glycerin | — | — | — | 6 | — |

TABLE IV

| Polymer | Composition | $M_W$ | Reflec-tance (Y) | Net Change (ΔY) |
|---|---|---|---|---|
| none | | | 63.3 | — |
| Example 1 | 95 AA/5 EA | 2500 | 65.6 | 2.3 |
| Example 2 | 90 AA/10 EA | 3400 | 64.7 | 1.4 |
| Example 3 | 95 AA/5 EA | 2100 | 64.2 | 0.9 |
| Example 4 | 81 AA/19 EA | 2120 | 63.3 | 0.0 |
| Example 5 | 70 AA/10 EA/20 MAL | 4590 | 62.2 | −1.1 |
| Example 6 | 40 AA/30 EA/30 NIS | 4760 | 63.0 | −0.3 |
| none | | | 63.1 | — |
| Example 7 | 100 AA | 1000 | 63.2 | 0.1 |
| Example 8 | 100 AA | 2000 | 64.3 | 1.2 |
| Example 9 | 100 AA | 4500 | 64.5 | 1.4 |
| Example 10 | 100 AA | 10000 | 63.9 | 0.8 |
| Example 11 | 100 AA | 40000 | 63.2 | 0.1 |
| Example 12 | 100 AA | 60000 | 62.7 | −0.4 |
| none | | | 64.8 | — |
| Example 13 | 80 AA/20 EA | 6470 | 65.7 | 0.9 |
| Example 14 | 80 AA/20 HPA | 6530 | 65.5 | 0.7 |
| Example 15 | 80 AA/20 ϕAA | 2850 | 64.7 | −0.1 |
| Example 16 | 80 AA/20 AM | 3290 | 65.5 | 0.7 |
| Example 17 | 80 AA/20 IA | 3810 | 64.9 | 0.1 |
| Example 18 | 80 AA/20 IA | 58700 | 64.7 | −0.1 |
| none | | | 63.4 | — |
| Example 19 | 70 AA/30 MAA | 3500 | 62.7 | −0.7 |
| Example 20 | 80 AA/20 MAA | 4000 | 61.5 | −1.9 |
| Example 21 | 100 MAA | 4000 | 61.4 | −2.0 |
| Example 22 | 80 MAA/20 NIS | 2080 | 63.7 | 0.3 |
| none | | | 62.5 | — |
| Example 23 | 80 AA/20 MAL | 4080 | 62.3 | −0.2 |
| Example 24 | 80 AA/20 MAL | 15200 | 62.1 | −0.4 |
| Example 25 | 65 AA/35 MAL | 11900 | 62.3 | −0.2 |
| Example 26 | 65 AA/35 MAL | 30000 | 61.7 | −0.8 |
| Example 27 | 40 AA/60 MAL | 4300 | 62.9 | 0.4 |
| Example 28 | 40 AA/60 MAL | 11700 | 61.8 | −0.7 |

KEY:

| | |
|---|---|
| AA | Percent by weight Acrylic Acid |
| EA | Percent by weight Ethyl Acrylate |
| MAL | Percent by weight Maleic Acid |
| NIS | Percent by weight Nonionic Surfactant |
| HPA | Percent by weight Hydroxypropyl Acrylate |
| ϕAA | Percent by weight Phenylacrylic Acid |
| AM | Percent by weight Acrylamide |
| IA | Percent by weight Itaconic Acid |
| MAA | Percent by weight Methacrylic Acid |

These results demonstrate that acrylic acid/ethyl acrylate copolymers are particularly effective for the removal of clay soils. Acrylic acid/ethyl acrylate copolymers show superior results compared to homopolymers, copolymers containing comonomers other than ethyl acrylate, and terpolymers.

We claim:

1. A method of enhancing clay soil removal properties comprising adding to a liquid, fabric softening laundry detergent from about 0.5 to about 5 percent by weight of a copolymer having a weight average molecular weight of from about 1,000 to about 30,000 containing as polymerized units a) from about 80 to about 98 percent by weight acrylic acid, and b) from about 2 to about 20 percent by weight ethyl acrylate wherein the liquid laundry detergent composition further comprising i) water;

ii) at least about 0.1 percent by weight optical brightener;

iii) at least one builder at a level of from 0.5 to 30 percent by weight of the liquid laundry detergent composition;

iv) at least one surfactant at a level of from 2 to 50 percent by weight of the liquid laundry detergent composition;

v) bleaching agents at a level up to 30 percent by weight of the liquid laundry detergent composition;

vi) corrosion inhibitors at a level up to 25 percent by weight of the liquid laundry detergent composition; and vii) graying inhibitors at a level up to 5percent by weight of the liquid laundry detergent composition.

2. The method of claim 1 wherein the copolymer contains as polymerized units a) about 90 percent by weight acrylic acid and b) about 10 percent by weight ethyl acrylate.

3. The method of claim 1 wherein the copolymer contains as polymerized units a) about 95 percent by weight acrylic acid and b) about 5 percent by weight ethyl acrylate.

4. The method of claim 1 wherein the copolymer has a weight average molecular weight of from about 1500 to about 10000.

5. The method of claim 1 wherein the copolymer has a weight average molecular weight of from about 2000 to about 7000.

6. A liquid fabric cleaning laundry detergent composition comprising:

(i) from about 0.5 to about 5 percent by weight of a copolymer having a weight average molecular weight of from about 1,000 to about 30,000 containing as polymerized units a) from about 80 to about 98 percent by weight acrylic acid, and b) from about 2 to about 20 percent by weight ethyl acrylate to a liquid laundry detergent composition;

ii) water;

iii) at least about 0.1 percent by weight of optical brightener;

iv) at least one builder at a level of from 0.5 to 30 percent by weight of the liquid laundry detergent composition;

v) at least one surfactant at a level of from 2 to 50 percent by weight of the liquid laundry detergent composition;

vi) bleaching agents at a level up to 30 percent by weight of the liquid laundry detergent composition;

vii) corrosion inhibitors at a level up to 25 percent by weight of the liquid laundry detergent composition; and viii) graying inhibitors at a level up to 5 percent by weight of the liquid laundry detergent composition.

7. The liquid laundry detergent composition of claim 6 wherein the copolymer is present at from about 1 to about 4 percent by weight of the detergent.

8. The liquid laundry detergent composition of claim 6 wherein the copolymer is present at about 3 percent by weight of the detergent.

9. The liquid laundry detergent composition of claim 6 wherein said composition is free of phosphate.

* * * * *